US006942401B2

(12) United States Patent
Piccinino, Jr. et al.

(10) Patent No.: US 6,942,401 B2
(45) Date of Patent: Sep. 13, 2005

(54) PHOTOGRAPHIC PROCESSING SYSTEM HAVING A VERTICAL STACKER ARRANGEMENT

(75) Inventors: Ralph L. Piccinino, Jr., Rush, NY (US); Daniel M. Pagano, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/780,305

(22) Filed: Feb. 17, 2004

(65) Prior Publication Data

US 2005/0180745 A1 Aug. 18, 2005

(51) Int. Cl.[7] ..... G03D 5/00; G03D 3/08

(52) U.S. Cl. ..... 396/604; 396/612; 396/627; 396/647; 355/27; 355/72

(58) Field of Search ..... 355/27–29, 72, 355/77; 396/598, 599, 604, 612, 627, 647, 396/636

(56) References Cited

U.S. PATENT DOCUMENTS

| | | | | |
|---|---|---|---|---|
| 4,927,322 | A * | 5/1990 | Schweizer et al. | 198/429 |
| 5,784,662 | A * | 7/1998 | Ridgway | 396/647 |
| 6,860,656 | B1 * | 3/2005 | Piccinino, Jr. | 396/604 |
| 2004/0076425 | A1 * | 4/2004 | Patterson et al. | 396/604 |

* cited by examiner

*Primary Examiner*—D. Rutledge
(74) *Attorney, Agent, or Firm*—David A. Novais

(57) ABSTRACT

The invention relates to a photographic processor and a method of processing photographic material. The photographic processor is adapted to achieve a high speed processing of photographic material by utilizing the combination of a vacuum platen and a stacker arrangement that is adapted to hold the media for a time necessary to process and/or dry the media. The system permits media to be fed to a first vacuum platen where a first solution is applied. The platen transports the media to a first vertical stacker arrangement, which holds the media for a desired processing time for the first solution. The media can then be pushed through a stop solution, if needed, and onto a second vacuum platen where a second solution can be applied. The media is then delivered to second vertical stacker arrangement that is designed to assure the proper amount of processing time for the second solution.

20 Claims, 3 Drawing Sheets

PHOTOGRAPHIC PROCESSING SYSTEM HAVING A VERTICAL STACKER ARRANGEMENT

FIELD OF THE INVENTION

The present invention relates to a photographic processing system which is adapted to achieve a high speed processing utilizing a stacker/drying arrangement.

BACKGROUND OF THE INVENTION

Conventional photographic systems for processing photographic material generally process the media in processing tanks, wherein the media is conveyed through the tanks so as to be in contact with several distinct processing solutions in each tank. The conveyance of the media essentially utilizes conveying rollers which in most instances touch both the emulsion and non-emulsion side of the photographic media. Further, the utilization of conveying rollers in most instances does not insure that the photographic media is held flat during the processing cycle. These factors generally affect the subsequent processing of the photographic media. Conventional photographic systems are also set forth in an in-line relationship that includes a plurality of processing tanks and a dryer and takes up a large footprint.

SUMMARY OF THE INVENTION

The present invention provides for a photographic processing system and method of processing photographic media which is adapted to provide for a high speed processing by utilizing the combination of a stacker/dryer arrangement and a vacuum platen. To achieve a high speed processing and maintain the required amount of developing time necessary for developing photographic media, the stacker/drying arrangement of the present invention is designed to provide enough dwell time for the media in the stacker arrangement to ensure adequate processing of the media.

In the system and method of the present invention, media is fed, then exposed (digitally or optically), on a vacuum platen where developer is applied. The vacuum platen is adapted to deliver the media to a vertical stacker arrangement, which holds the media for the desired developing time. After the developing stage, the media is pushed through a stop solution (if needed) and onto a valve jet bleaching platen to receive the proper amount of bleach. The media is then delivered to another stacker arrangement for the proper amount of bleach time, and then is delivered to a wash station for the proper amount of washing. The media is then delivered back to the first stacker arrangement for final drying and delivery to the exit side of the processing machine.

The present invention therefore relates to a photographic processor or processing machine that comprises a first solution application station adapted to apply a first solution onto photographic media to process the photographic media; a first vertical stacker arrangement adapted to receive the media from the first solution application station, wherein a travel time for the media in the first vertical stacker arrangement corresponds to a first solution processing time and a drying time for the photographic media; a second solution application station adapted to receive the media from the first vertical stacker arrangement and apply a second solution onto a photographic media; and a second vertical stacker arrangement adapted to receive the media from the second solution application station, wherein a travel time for the media in the second vertical stacker arrangement corresponds to a second solution processing time for the photographic media.

The present invention further relates to a method of processing photographic media which comprises the steps of applying a first solution onto photographic media at a first solution application station to process the photographic media; conveying the media having the first solution thereon to a first vertical stacker arrangement which is adapted to receive the media from the first solution application station and transport the media in a first vertical direction to a second solution application station, wherein a travel time for the media in the first vertical stacker arrangement corresponds to a first solution processing time and a drying time for the photographic media; applying a second solution onto the photographic media at the second solution application station which is adapted to receive the media from the first vertical stacker arrangement and apply the second solution onto the photographic media to process the media; and conveying the media having the second solution thereon to a second vertical stacker arrangement which is adapted to receive the media from the second solution application station and transport the media in a second vertical direction, wherein a travel time for the media in the second vertical stacker arrangement corresponds to a second solution processing time for the photographic media.

DETAILED DESCRIPTION OF THE INVENTION

Figure 1:
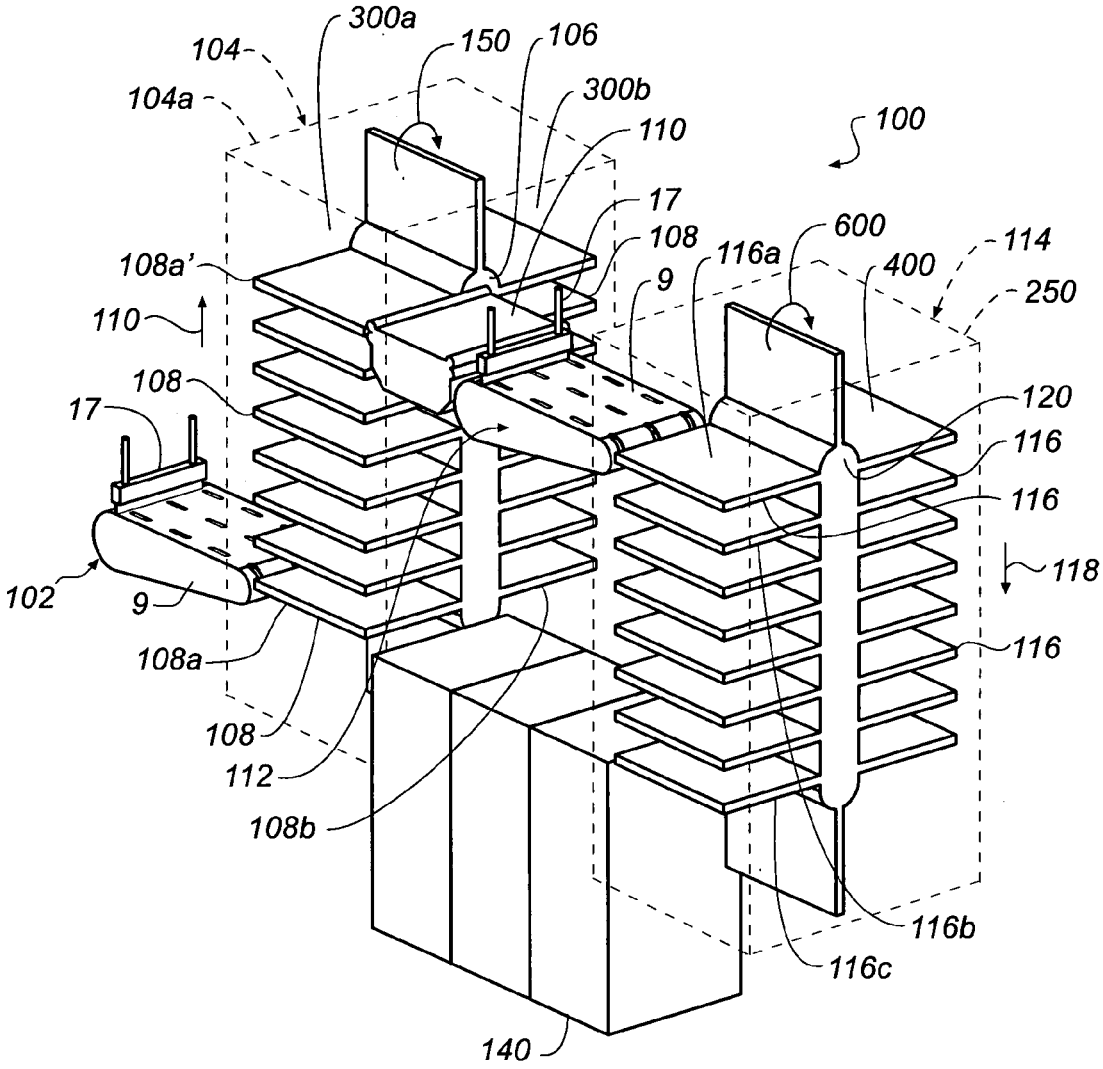
FIG. 1 is a view of a photographic processor in accordance with the present invention.

Referring now to the drawings, wherein like reference numeral designate identical or corresponding parts throughout the several views, FIG. 1 is a schematic illustration of a photographic processor 100 in accordance with the present invention.

Figure 2:
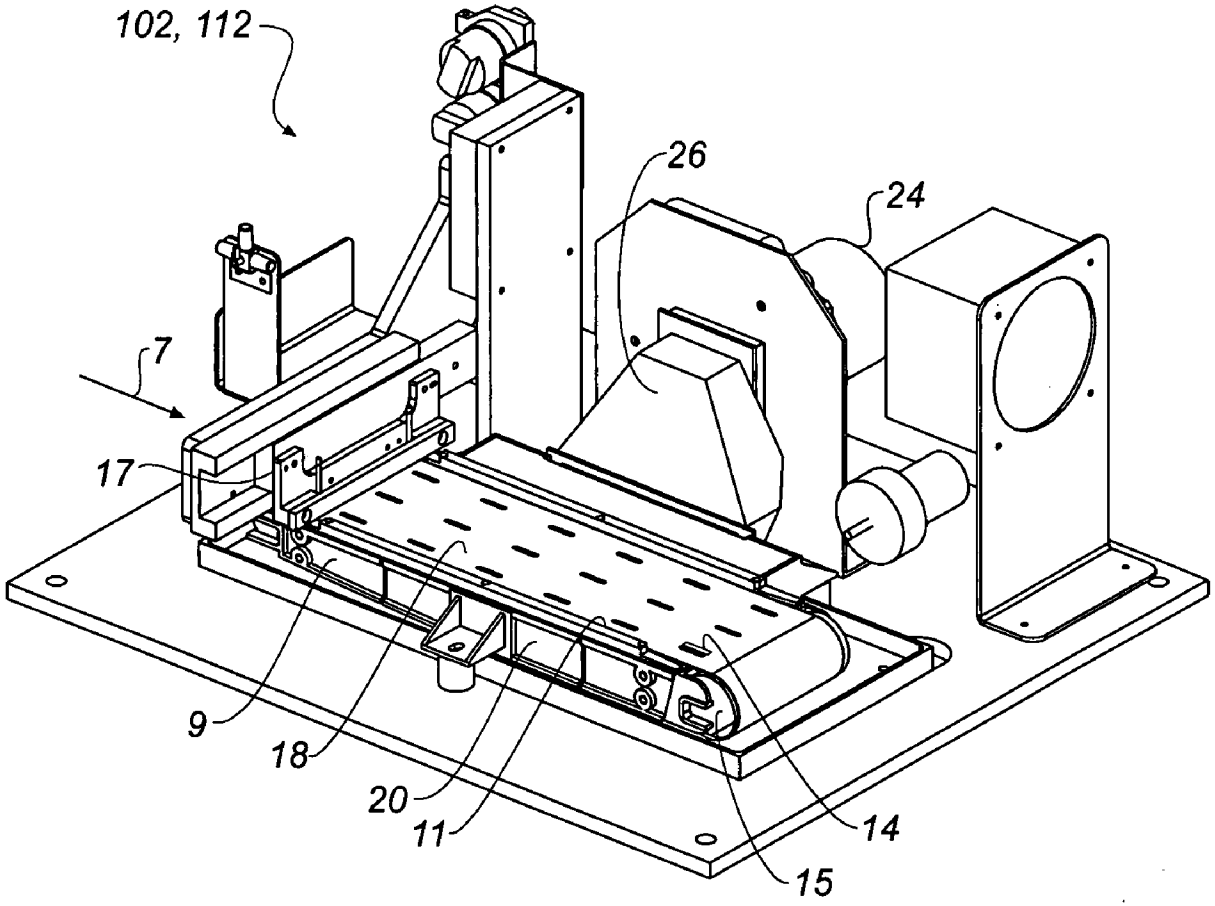
FIG. 2 is a view of a vacuum platen which makes up part of the photographic processor of FIG. 1.

Photographic processor 100 of FIG. 1 is adapted to process sheets of exposed photographic material. In photographic processor 100, a sheet of exposed photographic material is first conveyed to a first solution application station 102. First solution application station 102 includes a first solution supply member 17 which is adapted to supply a first processing solution onto the photographic media as the photographic media passes between first solution supply member 17 and a conveying path defined by a conveying member 9. Conveying member 9 is preferably of a vacuum platen type as described in copending application Ser. No. 10/714,008 filed Nov. 14, 2003. With reference to the specifics of first solution application station 102, reference is made to FIG. 2. As illustrated in FIG. 2, first solution application station 102 includes conveying member 9 which transports exposed photographic media in direction 7. Conveying member 9 preferably comprises an endless belt 11 having a plurality of slots, holes or apertures 14 therein. Endless belt 111 is wrapped around a pair of rollers 15, one of which is illustrated in FIG. 1. First solution application station 102 further includes processing solution supply member 17 as described above which has a plurality of discharge openings that face down onto a top surface 18 of belt 11. Processing solution supply member 17 preferably receives processing solution from a known supply source and is adapted to discharge or spray the processing solution onto photographic media on surface 18 of conveying belt 11, to permit a processing, such an impingement processing of the photographic media. Within the context of photographic processor 100 of the present invention, the preferred processing solution supplied by first solution application station 102 is a developing solution for developing exposed images on photographic media.

Therefore, in order to process an exposed photographic media (preferably a photographic sheet) at first solution application station 102, the sheet is supplied in the direction of arrow 7 onto conveying member 9. The sheet is directed onto top surface 18 of endless belt 11 and passes between the discharge openings of processing solution supply member 17 and surface 18 of belt 11. As the sheet passes between processing solution supply member 17 and top surface 18, processing solution is sprayed and/or supplied onto the top surface of the photographic sheet to process or develop the exposed images on the sheet.

Figure 3:
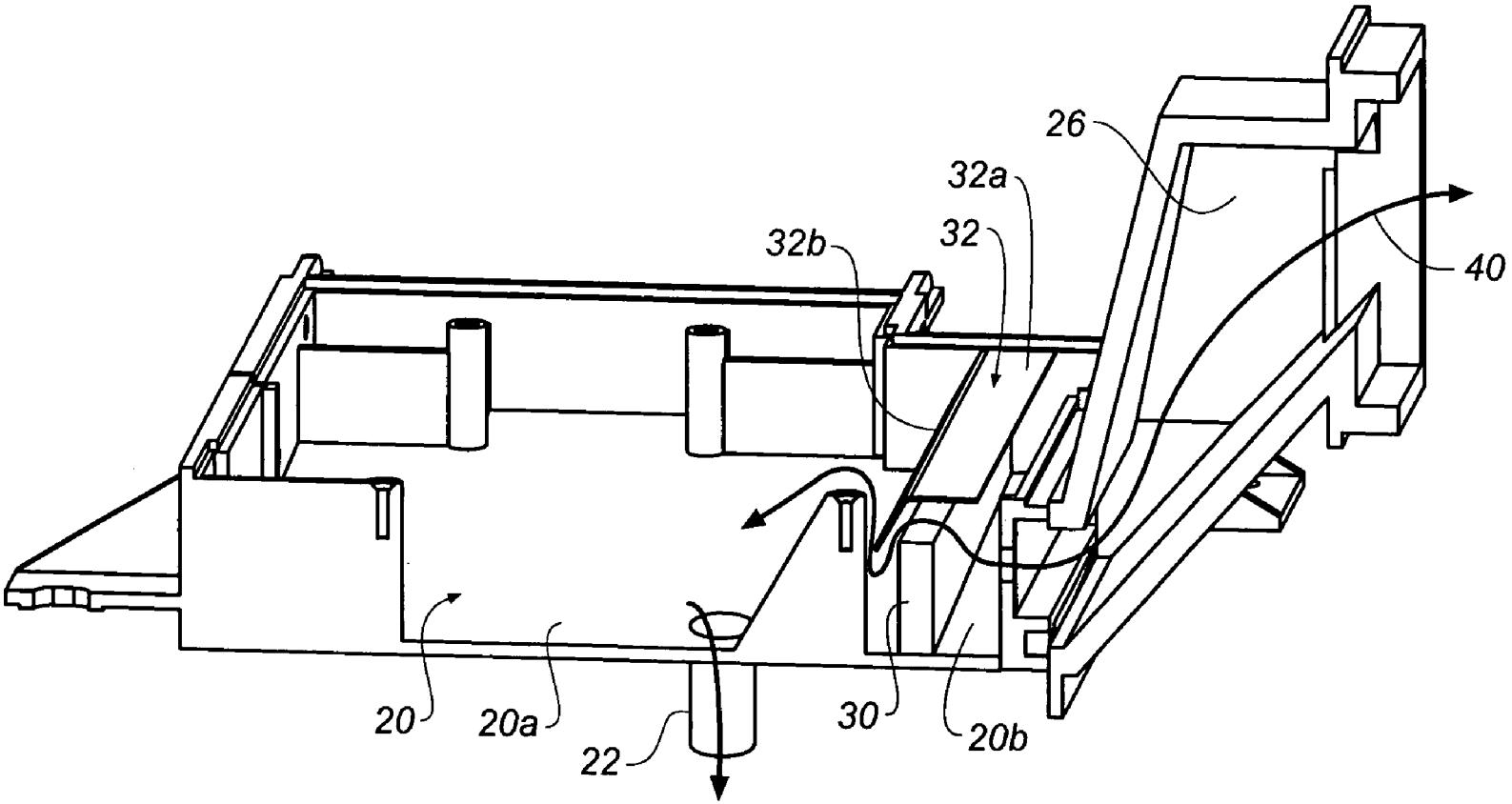
FIG. 3 is a view of a vacuum chamber and suction air path which makes up part of the vacuum platen of FIG. 2.

Belt 11 of conveying member 9 includes slots 14 as described above. Therefore, as the solution is sprayed onto the photographic sheet, excess solution which drips off the sheet will fall through slots 14 into a vacuum chamber 20 located below top surface 18 of belt 11. The interior of chamber 20 is illustrated in FIG. 3. Chamber 20 is preferably designed to receive excess solution which drips through slots 14 and appropriately drain the solution through a discharge line 22 to an appropriate drain site or to a site to be recycled.

During processing at first solution application station 102, it is preferable that the photographic sheet be held in a flat state. With the arrangement of the present invention, a vacuum source in the form of, for example, a vacuum pump 24 is adapted to apply a suction force through a suction path 26 as shown in FIGS. 2 and 3. This arrangement provides the advantage of transporting photographic sheets emulsion side up in a manner in which the emulsion side is not contacted and the non-emulsion side contacts the top surface 18 of belt 11. Further, the sheet is held flat during processing by the suction force applied by vacuum pump 24 through path 26 and slots 14. Thus, the suction force can be applied while the solution is being supplied to the media or after the solution is supplied to the media.

Photographic processing solution supplied from supply member 17 will leak down through slots 14 into chamber 20. This raises the possibility of the solution entering suction path 26 and vacuum pump 24 which could adversely affect the operation of pump 24. This is prevented by a wall 30 and a baffle 32 as shown in FIG. 3. Wall 30 generally divides vacuum chamber 20 into a first section 20*a* which is essentially located below belt 11, and a second section 20*b* which is closer to vacuum pump 24 than first section 20*a*. Baffle 32 is located generally above wall 30 and mounted on a wall of chamber 20. The combination of wall 30 and baffle 32 serves the dual purpose of (1) permitting the application of suction force from vacuum pump 24 and path 26 through slots 14 to hold photographic sheets flat during processing; and (2) preventing any processing solution which falls into first part 20*a* of vacuum chamber 20 from reaching path 26 and vacuum pump 24. Thus, the path of the suction air force is generally described by reference 40, and as shown, the suction force travels over the top surface of wall 30, between baffle 32 and wall 30, and extends between vacuum pump 24 and chamber 20*a*, to apply a suction force through slots 14 of belt 11.

Therefore, the combination of wall 30 and baffle 32 prevent processing solution from splashing throughout the processing system, maintains the solution within chamber 20*a* for drainage to drain 22, and prevents solution from reaching suction path 26 and contacting vacuum pump 24. That is, as shown in FIG. 3, baffle 32 preferably includes a generally flat or horizontal section 32*a* that extends above a top surface of wall 30 and an inclined section 32*b* which is inclined in a direction towards first part 20*a* of vacuum chamber 20. This provides for the guidance of the suction force from vacuum pump 26 and in addition, helps maintain the processing solution within the confines of part 20*a* of chamber 20.

Referring back to FIG. 1, in photographic processor 100 of the present invention, the preferred solution to be applied at first solution application station 102 is a developer solution for developing a latent image on an exposed photographic media. After the developing solution is applied to the photographic sheet at first solution application station 102, the sheet is transferred while being held flat to a first vertical stacker arrangement 104. First vertical stacker arrangement 104 preferably comprises an endless belt like member 106 which includes or is attached to a plurality of spaced media platforms 108. Therefore, after processing at first solution application station 102, conveying member 9 conveys the photographic media onto a media platform 108 provided at location 108*a*. Endless conveyor belt 106 can thereafter be actuated (i.e. rotated in direction 150) by way of, for example, a motor, so as to move media platform 108 provided at location 108*a* in a first vertical upward direction 110 as shown by the arrow in FIG. 1, so that the next media platform, for example, platform 108 at location 108*b*, will be located in a receiving position to received media from conveying member 9. In this way, multiple sheets can be provided in a serial manner onto individual media platforms 108 and transported in first vertical or upward direction 110.

In a feature of the present invention, the length of vertical stacker arrangement 104 or a dwell or travel time of the media on the different media platforms 108 of vertical stacker arrangement 104 can be controlled so as to provide for the proper drying time and proper developing time for the photographic media. That is, the number media platforms 108, the distance that the individual media platforms will travel from a position where it receives the media from first solution application station 9 to a point where it transfers the media to the next station, or the time that the media spends within first vertical stacker arrangement 104 can be controlled so as to provide for a proper developing time and a proper drying time for the media while in first vertical stacker arrangement 104. That is, a travel time for the media in first vertical stacker arrangement 104 corresponds to a proper developing time and/or proper drying time for the media. First vertical stacker arrangement 104 can be designed as an oven, such that media platforms 108 along with belt 106 are provided within an enclosure 104*a*, and the space within enclosure 104*a* can be heated by forced heated air, radiant heat or any other type of heating source.

Once media on media platform 108 at location 108*a* reaches a location or position identified by reference numeral 108*a*', the media is determined to have been substantially and/or properly developed and dried. Thereafter, the media can be pushed by any well known type of pushing mechanism from media platform 108 at location 108*a*' onto the next stage of the process. In the embodiment illustrated in FIG. 1, the next stage is a stop bath 110 having a stop solution therein. It is noted that the stop bath 110 is optional, and that in the event that the dwell time within vertical stacker arrangement 104 is sufficient to stop developing, the stop bath would not be needed. If stop bath 110 is utilized, the media is transported from media platform 108 at location 108*a*' onto stop bath 110 by a well known pusher mechanism, wherein the media comes into contact with stop solution for stopping the development of the media. Thereafter media is transported to a second solution application station 112. Otherwise, the media can be directly transferred from stacker arrangement 104 to second solution application station 112.

Second solution application station 112 is identical to first solution application station 102 and therefore, for the specifics of second solution application station 112, reference is made to FIGS. 2 and 3 and the supporting discussion of FIGS. 2 and 3 regarding first solution application station 102. That is, second solution application 112 is identical to first solution application 102 in that it includes a second conveying member 9, a second endless belt 11 having a plurality of slots, holes or apertures 14 therein, a second solution supply member 17, a second chamber 20, a second discharge line 22, a second vacuum pump 24 and a second path 26, all of which have been described with reference to FIGS. 2 and 3. Second solution application station 112 further includes wall 30, baffle 32 and the other elements described with respect to chamber 20 and path 26 previously described with reference to FIG. 3. A separate vacuum source could be used for second solution application station 112, or the same vacuum source used for first solution application station 102 can be used for second solution application station 112. Also, a single vacuum pump 24 could be used for both application stations 102, 112.

The difference between second solution application station 112 and first solution application station 102 is that the solution applied onto the media by second solution supply member 17 of second solution application station 112 is a bleaching solution. The applied bleaching solution serves to bleach the photographic media as it is conveyed and held flat along conveying member 9 of station 112. It is noted that the particulars for the elements of first solution application 102 and second solution application station 112 are described in the above-noted copending application Ser. No. 10/714,008.

After the application of the bleach solution at station 112, the photographic media is thereafter transported to the next station which is a second vertical stacker arrangement 114. Second vertical stacker arrangement 114 is adapted to transport the media in a second vertical direction, and more specifically in direction 118 as shown. Second vertical stacker arrangement 114 provides for a proper bleach dwell time for the media. Second vertical stacker arrangement 114 includes a plurality of spaced media receiving platforms 116 mounted on or attached to a conveyor belt 120 which is adapted to rotate each of the media receiving platforms 116 about belt 120. Thus, during use, photographic media is transferred from second solution application station 112 onto media platform 116 at location 116*a* as shown, and thereafter, belt 120 is driven in a direction shown by arrow 600 by a known motor to move media platform 116 at location 116*a* in downward direction 118; this brings next media platform 116 at location 116*b* in alignment with second conveying member 9 of second solution application station 112. In the same manner as first vertical stacker arrangement 104, second vertical stacker arrangement 114 can be designed with respect to its dwell time, its length or its number of platforms so as to provide for the proper dwell time for the bleach on the photographic media. That is, a travel time for the media in second vertical stacker arrangement 114 corresponds to a proper bleach processing time for the media. Second vertical stacker arrangement 114 can be optionally enclosed by an enclosure or casing 250.

After platform 116 reaches location or position 116*c* as shown in FIG. 1, the photographic media can be pushed by a well-known pusher into a wash station 140. Wash station 140 could be a known wash station having a plurality of wash and/or rinse tanks and conveying rollers which serially lead the photographic media through several washing or rinsing stations or tanks. Wash station 140 can further be of the counter current wash type wherein washing fluid is applied in a direction opposite to the conveying direction of the media so as to assure that the photographic media is properly washed. After leaving wash station 140, the media can be returned by way of a movement arm, a conveying belt or a roller back to an aligned receiving platform 108 at position 108*a* of first vertical stacker arrangement 104, so as to perform a drying operation on the developed and washed media. This drying operation can be achieved by designing first vertical stacker arrangement 104 as an oven or as an enclosure with forced air or radiant heat as previously described. Thereafter, the media can be removed from processor 100 for further finishing operations.

It is noted that first vertical stacker arrangement 104 includes a side 300*a* where platforms 108 are located so as to receive the media from first solution application station 102. After each of platforms 108 reach a point where the media can be transported to either stop bath 110 or second solution application station 112, belt 106 is effective to rotate each of platforms 108 in direction 150 so that the platforms are now on a side 300*b* of first vertical stacker arrangement 104. At side 300*b*, an optional spraying station (not shown) can be utilized to apply washing or rinsing solution onto each of platforms 108 at side 300*b*. This is effective to remove any residual developer solution from platforms 108. The same operation can be also achieved with respect to second vertical stacker arrangement 114. That is, platforms 116 positioned on side 400 as shown in FIG. 1 can be cleaned by a washing arrangement, such as a sprayer located in the vicinity of side 400. This is effective to remove any residual bleach from each of platforms 116.

The present invention thus provides for a photographic processor which is capable of achieving a rapid processing while holding a sheet flat. The processor further enables a proper development time, drying time and bleaching time for the media. The processor of the present invention is compact as shown in FIG. 1 in that each of vertical stacker arrangements 104, 114 can be located on opposing sides of second solution application station 112 and on opposing sides of washing station 140 in a parallel manner. This provides for a minimum footprint for the photographic processor. The photographic processor can be further enclosed in a single housing or each of the elements can be provided in separate housings.

The invention has been described in detail with particular reference to certain preferred embodiments thereof, but it will be understood that variations and modifications can be effected within the spirit and scope of the invention.

What is claimed is:

1. A photographic processor comprising:

a first solution application station adapted to apply a first solution onto photographic media to process the photographic media;

a first vertical stacker arrangement adapted to receive the media from the first solution application station, wherein a travel time for the media in said first vertical stacker arrangement corresponds to a first solution processing time and drying time for the photographic media;

a second solution application station adapted to receive the media from the first vertical stacker arrangement and apply a second solution onto the photographic media; and a second vertical stacker arrangement adapted to receive the media from the second solution application station, wherein a travel time for the media in said second vertical stacker arrangement corresponds to a second solution processing time for the photographic media.

2. A photographic processor according to claim 1, further comprising:

a wash station adapted to receive the media from the second vertical stacker arrangement and wash the media.

3. A photographic processor according to claim 2, wherein said first vertical stacker arrangement is adapted to receive the media after the wash station and hold the media to permit a drying of the media.

4. A photographic processor according to claim 1, wherein said first solution application station comprises:

a first conveying member adapted to transport the media to be processed, said first conveying member comprising a plurality of first slots and being provided on top of a first vacuum chamber;

a first solution supply member adapted to apply the first solution onto the media on said first conveying member to process said media; and a first vacuum air source adapted to apply a first vacuum suction force to said first vacuum chamber, such that said first suction force passes through said first slots on said first conveying member to hold the media on said first conveying member flat.

5. A photographic processor according to claim 1, wherein said second solution application station comprises:

a second conveying member adapted to transport the media to be processed, said second conveying member comprising a plurality of second slots and being provided on top of a second vacuum chamber; and a second solution supply member adapted to apply the second solution onto the media on said second conveying member to process said media;

wherein said first vacuum air source or a second vacuum air source is adapted to apply a second vacuum suction force to said second vacuum chamber, such that said second suction force passes through said second slots on said second conveying member to hold the media on said second conveying member flat.

6. A photographic processor according to claim 1, wherein said first solution is a developing solution which develops a latent image on said photographic media and said second solution is a bleach solution.

7. A photographic processor according to claim 1, further comprising a stop bath located between an exit from the first vertical stacker arrangement and an entrance to said second solution application station, said stop bath being adapted to apply a stop solution to said media to stop development of said media.

8. A photographic processor according to claim 1, wherein said first vertical stacker arrangement comprises a plurality of spaced first media platforms positioned in a vertical direction, each first media platform being adapted to receive media from the first solution application station and transport the media in a first vertical direction to said second solution application station.

9. A photographic processor according to claim 2, wherein said second vertical stacker arrangement comprises a plurality of spaced second media platforms positioned in a vertical direction, each second media platform being adapted to receive media from the second solution application station and transport the media in a second vertical direction to said wash station.

10. A photographic processor according to claim 8, wherein each of said first media platforms are operationally associated with a first moving member which is adapted to move each of said first media platforms.

11. A photographic processor according to claim 10, wherein said first moving member is a first endless belt.

12. A photographic processor according to claim 9, wherein each of said second media platforms are operationally associated with a second moving member which is adapted to move each of said second media platforms.

13. A photographic processor according to claim 12, wherein said second moving member is a second endless belt.

14. A photographic processor according to claim 2, wherein said second solution application station is located above said wash station, and each of said first and second vertical stacker arrangements are parallel to each other and located on opposite sides of said second solution application station and said wash station.

15. A method of processing photographic media, the method comprising the steps of:

applying a first solution onto photographic media at a first solution application station to process the photographic media;

conveying the media having the first solution thereon to a first vertical stacker arrangement which is adapted to receive the media from the first solution application station and transport the media in a first vertical direction to a second solution application station, wherein a travel time for the media in said first vertical stacker arrangement corresponds to a first solution processing time and a drying time for the photographic media;

applying a second solution onto the photographic media at a second solution application station which is adapted to receive the media from the first vertical stacker arrangement and apply the second solution onto the photographic media to process the media; and conveying the media having the second solution thereon to a second vertical stacker arrangement which is adapted to receive the media from the second solution application station and transport the media in a second vertical direction, wherein a travel time for the media in said second vertical stacker arrangement corresponds to a second solution processing time for the photographic media.

16. A method according to claim 15, further comprising the step of:

conveying the media from the second vertical stacker arrangement to a wash station which is adapted to wash the media.

17. A method according to claim 16, further comprising the step of:

conveying the media from the wash station back to the first vertical stacker arrangement to dry the media.

18. A method according to claim 15, wherein said step of applying a first solution onto the photographic media comprises applying a developing solution onto the media to develop a latent image on the media.

19. A method according to claim 15, wherein said step of applying a second solution onto the photographic media comprises applying a bleach solution onto the media.

20. A method according to claim 19, wherein after the media exits said first vertical stacker arrangement and prior to the transport of the media to the second solution application station, the method comprises conveying the media through a stop bath having a stop solution therein to stop a development of said media.

* * * * *